US008804994B2

(12) United States Patent
Alvarez Ibarra

(10) Patent No.: US 8,804,994 B2
(45) Date of Patent: Aug. 12, 2014

(54) SPEAKER ENCLOSURE FORMING PART OF THE SPEAKER TO AID IN DISASSEMBLY OF SPEAKER COMPONENTS

(76) Inventor: Rigoberto Alvarez Ibarra, Nuevas Casas Grandes (MX)

( * ) Notice: Subject to any disclaimer, the term of this patent is extended or adjusted under 35 U.S.C. 154(b) by 192 days.

(21) Appl. No.: 13/476,204

(22) Filed: May 21, 2012

(65) Prior Publication Data

US 2013/0308815 A1 Nov. 21, 2013

(51) Int. Cl.
*H04R 1/02* (2006.01)
*H04R 1/20* (2006.01)
*H04R 25/00* (2006.01)

(52) U.S. Cl.
USPC ..... 381/386; 381/150; 381/345

(58) Field of Classification Search
CPC ..... H04R 1/02; H04R 1/22
USPC ..... 381/386, 150, 345; 181/145, 148
See application file for complete search history.

(56) References Cited

U.S. PATENT DOCUMENTS 1,760,862 A * 5/1930 Weinberger et al. ..... 181/151

FOREIGN PATENT DOCUMENTS

JP 9-233582 * 9/1997 ..... H04R 1/02

* cited by examiner

*Primary Examiner* — Brian Ensey
(74) *Attorney, Agent, or Firm* — Weiss & Moy, P.C.; Jeffrey D. Moy

(57) ABSTRACT

A speaker enclosure has an enclosure having an open front section. A partition is formed in the enclosure. A cone is coupled to the partition, wherein an outer perimeter of the cone is unattached from the enclosure forming a gap between the outer perimeter of the cone and the enclosure. A coil assembly is coupled to the cone. A magnet unit is coupled to the cone.

14 Claims, 3 Drawing Sheets

SPEAKER ENCLOSURE FORMING PART OF THE SPEAKER TO AID IN DISASSEMBLY OF SPEAKER COMPONENTS

RELATED APPLICATION

The present patent application is related to Mexican Patent Application MX/E/2012/010056, filed Feb. 2, 2012, in the name of Applicant, to which priority is claimed.

BACKGROUND

Embodiments of this disclosure relate generally to a speaker and, more specifically, to a speaker in which the enclosure forms part of the speaker in such a way that a cone, a coil and/or magnets of the speaker may be disassembled if any of the parts is damaged, so that the damaged part may be replaced easily.

A speaker enclosure is what we know currently as a cabinet having a separate loudspeaker therein. The loudspeaker may be comprised of a cylindrical permanent magnet, within which there is a coil that slides without friction and which in turn is attached to a corrugated fabric membrane. The coil may move freely without touching pole ends which may generate a magnetic field that attracts or repels the coil according to the intensity of the electrical impulse that it receives, moving with it the fabric membrane located at the other end attached or glued to a basket. A moving coil is made of insulated aluminum or copper winding mounted on top of an aluminum base or any similar material. Silver wire is commonly used, soldered or tinned to the ends of the coil and attached to the external terminals where the speaker will be connected to sound equipment.

In present speaker enclosures, the space between the ferrous materials is narrow. Furthermore, the thickness of the magnet and the length of the coil determine the length of the motion of such coil. The parallel alignment between magnet and coil must be kept at all times because if there is friction, it will distort the sound.

Therefore, it would be desirable to provide a system and method that overcomes the above issues. The system and method wherein the speaker enclosure forms part of the speaker in such a way that a cone, a coil and/or magnets of the speaker may be disassembled if any of the parts is damaged, so that the damaged part may be replaced easily

SUMMARY

A speaker enclosure has an enclosure having an open front section. A partition is formed in the enclosure. A cone is coupled to the partition, wherein an outer perimeter of the cone is unattached from the enclosure forming a gap between the outer perimeter of the cone and the enclosure. A coil assembly is coupled to the cone. A magnet unit is coupled to the cone.

A speaker enclosure has an enclosure having an open front section. A partition is formed in the enclosure. A magnet unit is attached to a rear side of the partition. A coil assembly is attached to a front side of the partition. A cone is attached to the coil assembly and positioned within the enclosure, wherein an outer perimeter of the cone is unattached from the enclosure forming a gap between the outer perimeter of the cone and the enclosure.

A speaker enclosure has an enclosure having an open front section. A partition is formed in the enclosure. A magnet unit is attached to a rear side of the partition. A coil assembly is attached to a front side of the partition. A cone attached is to the coil assembly and positioned within the enclosure, wherein an outer perimeter of the cone is unattached from the enclosure forming a tapered gap between the outer perimeter of the cone and the enclosure. A cylinder has a first end attached to a center area of the cone and a second end attached to the coil assembly.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
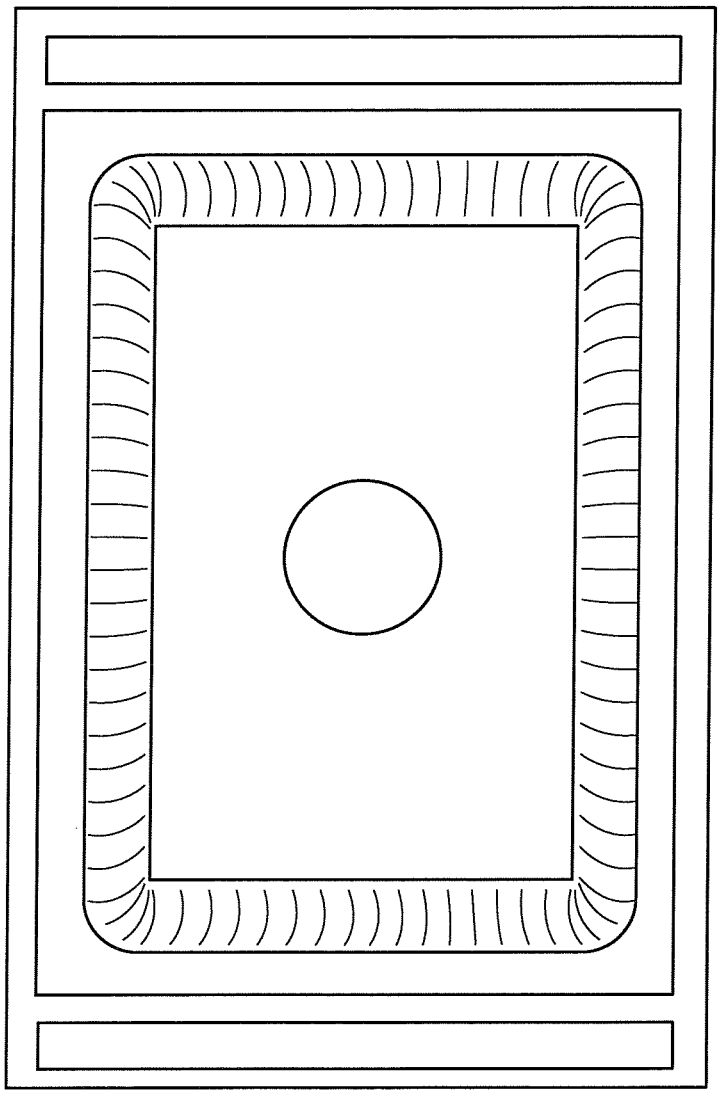
FIG. 1 shows a front view of the speaker enclosure.
Figure 2:
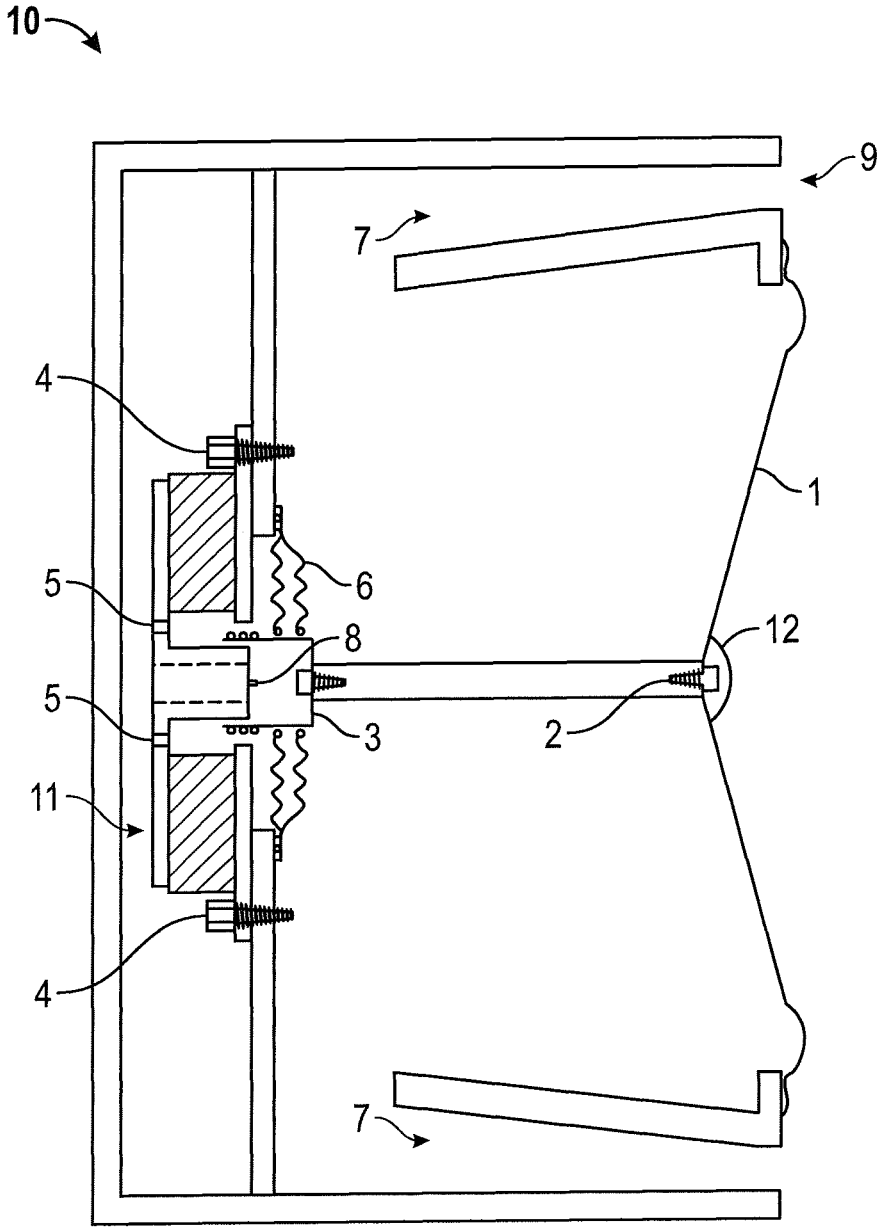
FIG. 2 shows a top view of a cross section of the speaker enclosure showing the design and arrangement.
Figure 3:
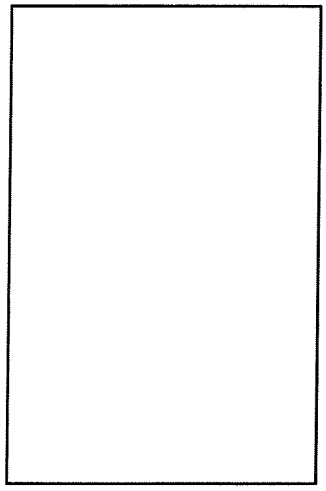
FIG. 3 shows a bottom view of the speaker enclosure, showing the top and bottom views being substantially the same.
Figure 4:
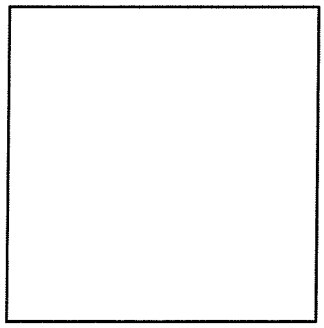
FIG. 4 shows a left lateral view of the speaker enclosure, showing that the right view is substantially the same.
Figure 5:
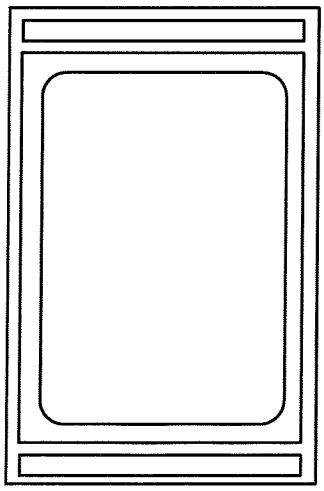
FIG. 5 is a front view of the speaker enclosure without the cone.

This invention references a mechanism that emits sound. The mechanism which has a cone (9) located on the front part (1) of the enclosure (10) with the difference that the cone of a normal speaker would be attached to a metallic basket.

The cone (9) is bolted at the center to an end of a metal or plastic cylinder (2), the opposite end of which is bolted to the coil unit (3), which coils are affixed to the internal rear part of the enclosure (10).

Inside the enclosure (10) there is a partition made of the same material as the cabinet, separating an area in the front interior, where the cone (9), the cylinder and the fabric membranes are located, while the magnet unit (11) is located in the rear interior area.

The magnet unit (11) is closely aligned with the coils and it is symmetrically affixed with screws (4), in this case it is shown with at least 3 screws, though it is preferable with 4 fasteners. On the magnet's base is an external metallic ferrous plate showing orifices (5) that connect to the air chamber where the coils slide in.

The rear cover is necessary to avoid the loss of internal pressure in the speaker enclosure (10) but also allows the air flow to cool the coil of the coil unit (3) with the coil's own movement. It should be noted that when using a square or a rectangular cone, a larger area of the front is used achieving with this a larger air flow, so it is desirable that the material used for the cone (9) (aluminum, plastic or paper) be strong enough and light at the same time to withstand the stresses caused, when considering a higher wattage.

The centering units are membranes of a corrugated fabric (6) which allow a parallel movement of the speakers, in this case there are 2 provided to insure the coils do not deviate due to the weight of the cylinder connected to the cone (9).

The enclosure has air vents (7) arranged from larger to smaller (i.e., tapered) resulting in a higher final air pressure.

The ferrous base that is attached to the magnet on the exterior area has openings that allow air flow to cool the coil and also has a central opening (8) of a size that will allow the cylinder to be bolted at one of the ends.

The area where the cone is attached to the cylinder must be covered with a lid or dust cover (12).

It is understood that this speaker enclosure shall be used preferable when it is required to transmit middle or low frequencies, as well as to be used basically on vehicles and professionally for musical groups and in case of being used in homes, it should be used as a complement for mid range or bass sounds.

This speaker enclosure could be configured with a magnet of multiple coils, that can be configured by the user according to his/her needs.

While the invention has been particularly shown and described with reference to preferred embodiments thereof, it will be understood by those skilled in the art that the foregoing and other changes in form and details may be made therein without departing from the spirit and scope of the invention

What is claimed is:

1. A speaker enclosure comprising:

an enclosure having an open front section;

a partition formed in the enclosure;

a cone coupled to the partition, wherein an outer perimeter of the cone is unattached from the enclosure forming a gap between the outer perimeter of the cone and the enclosure;

a coil assembly coupled to the cone; and a magnet unit coupled to the cone;

wherein the cone and coil assembly are positioned in front of the partition and the magnet unit is positioned behind the partition.

2. The speaker enclosure of claim 1, wherein the gap is tapered.

3. The speaker enclosure of claim 1, wherein the gap is tapered so a front section of the gap is narrower than a rear section.

4. The speaker enclosure of claim 1, further comprising a cylinder having a first end coupled to a center area of the cone and a second end attached to the coil assembly.

5. A speaker enclosure comprising:

an enclosure having an open front section;

a partition formed in the enclosure;

a magnet unit attached to a rear side of the partition;

a coil assembly attached to a front side of the partition; and a cone attached to the coil assembly and positioned within the enclosure, wherein an outer perimeter of the cone is unattached from the enclosure forming a gap between the outer perimeter of the cone and the enclosure.

6. The speaker enclosure of claim 5, wherein the gap is tapered.

7. The speaker enclosure of claim 5, wherein the gap is tapered so a front section of the gap is narrower than a rear section.

8. The speaker enclosure of claim 5, further comprising a cylinder having a first end coupled to a center area of the cone and a second end attached to the coil assembly.

9. The speaker enclosure of claim 5, further comprising a ferrous base attached to the magnet unit.

10. The speaker enclosure of claim 5, further comprising:

a ferrous base attached to the magnet unit;

openings formed on an exterior area of the ferrous base to allow air flow to cool the coil.

11. A speaker enclosure comprising:

an enclosure having an open front section;

a partition formed in the enclosure;

a magnet unit attached to a rear side of the partition;

a coil assembly attached to a front side of the partition;

a cone attached to the coil assembly and positioned within the enclosure, wherein an outer perimeter of the cone is unattached from the enclosure forming a tapered gap between the outer perimeter of the cone and the enclosure; and a cylinder having a first end attached to a center area of the cone and a second end attached to the coil assembly.

12. The speaker enclosure of claim 11, further comprising a ferrous base attached to the magnet unit.

13. The speaker enclosure of claim 11, further comprising:

a ferrous base attached to the magnet unit;

a first set of openings formed on an exterior area of the ferrous base to allow air flow to cool the coil.

14. The speaker enclosure of claim 11, further comprising a central opening formed on the ferrous base to allow the cylinder to be bolted at one of the ends.

* * * * *